US009038838B2

(12) United States Patent
Skeid

(10) Patent No.: US 9,038,838 B2
(45) Date of Patent: May 26, 2015

(54) INTERMODAL CONTAINER

(71) Applicant: Eirik Smedsrud Skeid, Fornebu (NO)

(72) Inventor: Eirik Smedsrud Skeid, Fornebu (NO)

( * ) Notice: Subject to any disclaimer, the term of this patent is extended or adjusted under 35 U.S.C. 154(b) by 158 days.

(21) Appl. No.: 13/735,732

(22) Filed: Jan. 7, 2013

(65) Prior Publication Data

US 2014/0190963 A1 Jul. 10, 2014

(51) Int. Cl.

*B65D 90/00* (2006.01)
*B65D 88/12* (2006.01)
*B65D 88/52* (2006.01)

(52) U.S. Cl.

CPC ..... *B65D 88/12* (2013.01); *B65D 88/528* (2013.01); *B65D 90/00* (2013.01); *B65D 90/0006* (2013.01); *B65D 90/0066* (2013.01); *B65D 2590/0066* (2013.01)

(58) Field of Classification Search

CPC ..... B65D 2519/00338; B65D 2519/00532
USPC ..... 220/4.28, 4.31
See application file for complete search history.

(56) References Cited

U.S. PATENT DOCUMENTS 2,579,655 A * 12/1951 Archibald ..... 220/6
2,898,122 A * 8/1959 Beckner ..... 280/28.12
3,883,026 A * 5/1975 Selz ..... 220/6
3,981,410 A * 9/1976 Schurch ..... 220/6
4,150,762 A * 4/1979 Brunette ..... 220/485
4,174,045 A * 11/1979 Heller et al. ..... 220/4.28
4,324,172 A * 4/1982 Cazals et al. ..... 99/277.1
4,662,532 A * 5/1987 Anderson et al. ..... 220/7
4,715,508 A * 12/1987 Schurch ..... 220/7
4,735,330 A * 4/1988 Hoss ..... 220/6
5,415,311 A * 5/1995 Coogan ..... 220/6
5,595,305 A * 1/1997 Hart ..... 206/600
D402,037 S * 12/1998 Hofstad ..... D34/38
6,006,918 A * 12/1999 Hart ..... 206/600
6,164,476 A * 12/2000 Rene et al. ..... 220/4.31
6,170,686 B1 * 1/2001 Flores ..... 220/4.33
RE39,444 E * 12/2006 Rene et al. ..... 220/4.31
D603,123 S * 10/2009 Canters et al. ..... D34/38
D609,425 S * 2/2010 Svedberg ..... D34/38
7,987,796 B2 * 8/2011 Nordstrom et al. ..... 108/53.3
8,631,965 B2 * 1/2014 Leasure ..... 220/682
8,905,254 B2 * 12/2014 Joubert ..... 220/1.5
2008/0193247 A1 * 8/2008 Zupancich et al. ..... 410/92

* cited by examiner

*Primary Examiner* — Fenn Mathew
*Assistant Examiner* — Christopher McKinley
(74) *Attorney, Agent, or Firm* — Michael A. Blake

(57) ABSTRACT

An intermodal container comprising: a plurality of self-centering volume maximizing posts; where the width of the container is about 38 inches to about 52 inches, the length is about 44 inches to about 110 inches, and the height is about 28 inches to about 88 inches; a plurality of side support members that act as very stiff springs that can provide shock dampening effects and reduce vibration to the interior of the container; a plurality of removable blocking and bracing members attached to support members; and where the cross-sectional area of each of the posts has more than 4 bends, where the bends are configured to provide greater strength to the posts while allowing for use of a lighter material.

16 Claims, 14 Drawing Sheets

INTERMODAL CONTAINER

TECHNICAL FIELD

The invention relates to transport containers, and, more particularly, to intermodal transport containers that efficiently use the available space in a transportation means.

BACKGROUND

Currently in the transportation industry, wooden pallets are used to store material when shipping, and pallet racking systems are used when in storage. Because the wooden pallet has only a bottom and generally no sides, material to be transported is loaded on top of the pallet and secured using shrink wrap which is also a protection mechanism for the material. There is no known designed stacking mechanism for pallets so they are stacked only if the material loaded presents a flat enough surface to load another pallet on top it. The pallet racking systems are usually fixed inside of buildings and are not adjustable for load sizes.

In both instances described above it is not possible to maximize available space in the transportation means, such as a road, air, rail, and sea, and protect or secure the load fully.

Currently wood is used for blocking and bracing of loads inside of a shipping container. Based on the sizes and dimensions of pallets or other loaded items, wood is cut to size and placed to brace the internal load. This wood is cut to specific load configurations and usually cannot be used for the same application more than once so it is discarded when the shipping container is unloaded.

Other known intermodal containers do not provide shock dampening, self-centered stacking and maximizing of available space. Other known intermodal containers are generally very heavy which leads to problems in of itself.

Thus there is a need for an intermodal container that overcomes the above listed and other disadvantages.

SUMMARY OF THE INVENTION

The disclosed invention relates to an intermodal container comprising: a first post, the first post having a self-centering cross-section at the top of the post and the bottom of the post, and having an angle $\alpha$ facing towards the interior of the container and tending to maximize the volume available inside the container for transporting material; a second post, the second post having a self-centering cross-section at the top of the post and the bottom of the post, and having an angle $\alpha$ facing towards the interior of the container and tending to maximize the volume available inside the container for transporting material; a third post, the third post having a self-centering cross-section at the top of the post and the bottom of the post, and having an angle $\alpha$ facing towards the interior of the container and tending to maximize the volume available inside the container for transporting material; a fourth post, the fourth post having a self-centering cross-section at the top of the post and the bottom of the post, and having an angle $\alpha$ facing towards the interior of the container and tending to maximize the volume available inside the container for transporting material; a first side panel attached to two posts; a second side panel attached to two other posts; a front panel attached to two posts, the front panel comprising at least two front panel supports; a rear panel attached to two other posts, the rear panel comprising at least two rear panel supports; at least one shelf attached to the first, second, third, and fourth posts, and where the shelf can attach to posts at a plurality of heights from the bottom of the container; where the width of the container is about 38 inches to about 52 inches, the length is about 44 inches to about 110 inches, and the height is about 28 inches to about 88 inches; a side support member attached to a post and generally located in the same plane as the first side panel, the side support member having one or more bends configured such that the side support member acts as a very stiff spring that can provide shock dampening effects and reduce vibration to the interior of the container; a front support member attached to a post, and generally located in the same plane as the front panel, the front support member having one or more bends configured such that the front support member acts as a very stiff spring that can provide shock dampening effects and reduce vibration to the interior of the container; a removable blocking and bracing member attached to the front support member; at least one tab extending from the shelf, and configured to slide into at least two of the group selected from the group consisting of the first side panel, the second side panel, the front panel, and the rear panel, thus when the tab is slid into two of the group, and the two of the group are in place in the container, the shelf cannot be removed; a slideable member slideably attached to one of the front panel supports and to an adjacent post, a hole located in the slideable member between the front panel support and the adjacent post when the slideable member is fully engaged with the front panel support and the adjacent post; a locking devices removeably attachable to the hole, and when removeably attachable to the hole, the slideable member cannot be removed from the post and the front panel support thereby locking the front panel in place with respect to the adjacent post; and where the cross-sectional area of each of the posts has more than 4 bends, where the bends are configured to provide greater strength to the posts while allowing for use of a lighter material.

BRIEF DESCRIPTION OF THE DRAWINGS

The present disclosure will be better understood by those skilled in the pertinent art by referencing the accompanying drawings, where like elements are numbered alike in the several figures, in which.

DETAILED DESCRIPTION

Figure 1:
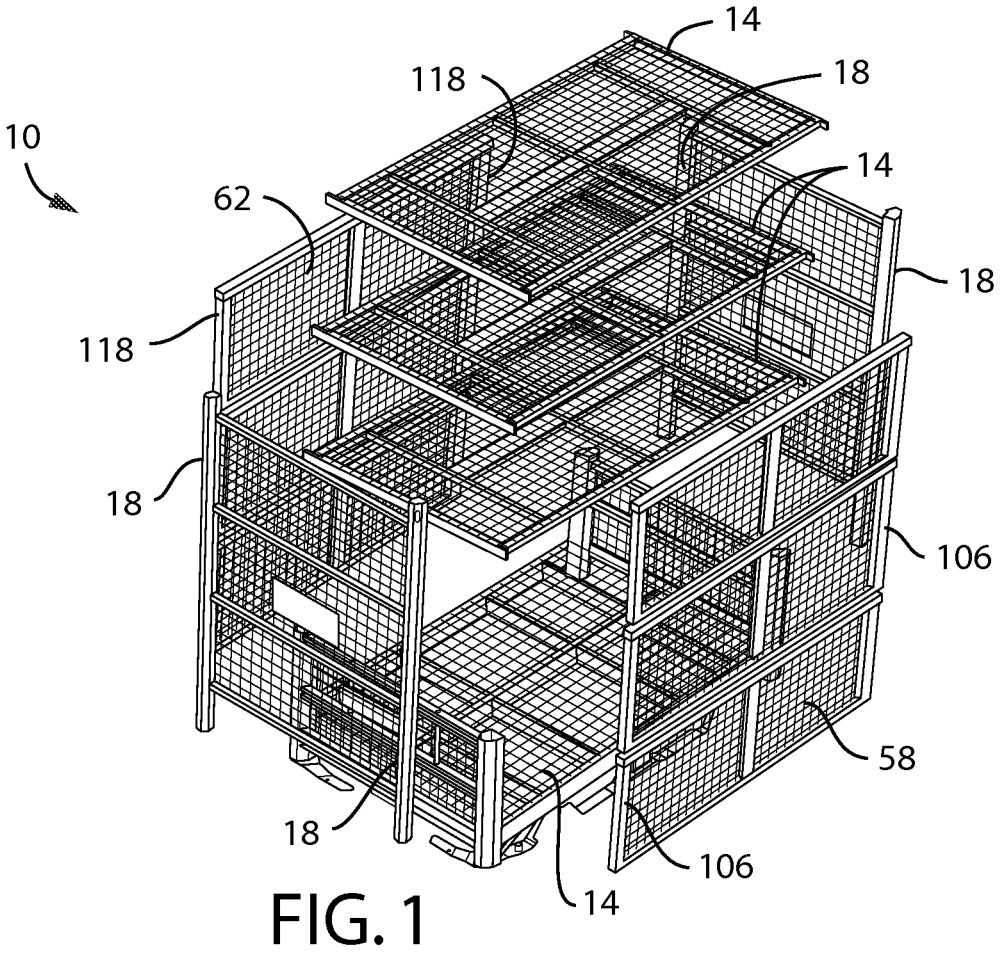
FIG. 1 is an exploded view of one embodiment of the disclosed intermodal container.

The disclosed intermodal container may be an industrial strength container designed to protect and secure material during storage and transportation while generally maximizing the available space in shipping assets for road, rail, air and sea. Additional space saving may be achieved while in storage since the disclosed intermodal container is generally stackable when loaded with material and generally collapsible to a generally flat configuration when empty.

A known problem associated with shipping material is maximizing the available space in different shipping modes. The disclosed intermodal container solves this problem by not only generally maximizing space in one type of shipping mode but also being transferrable to a different mode and also maximizing that space as well, i.e. the intermodal container may occupy about 90% of the space available in a 20 foot ISO container for shipping by sea and then be transferred to an air pallet where it may occupy about 99% of the space allowed without having to change the configuration.

A second known problem associated with shipping material is protecting the material loaded inside the container. Most material is damaged during movement by the vibration of the load and motion of the material within the space it has occupied. The disclosed intermodal container has adjustable shelves and divider walls to limit the space where material is loaded and can moved due to vibration and motion of transportation. The disclosed intermodal container minimizes vibration through a shock dampening design that has been incorporated into the base of the disclosed intermodal container to reduce impact shock on the material loaded inside the disclosed intermodal container.

Another problem associated with shipping material is how to block and brace loads for ship movement. When moving material by ship the loads have to be braced preventing movement caused by momentum when traveling in water. The disclosed intermodal container may have an integrated blocking and bracing system.

Keeping the material secure is another issue. One or more design elements of the disclosed intermodal container make it impossible to access the material being transported when assembled without removing the front panels. The front panels may be secured in place with a lock in a slide bar that engages the end wall of the disclosed intermodal container.

Other issues the disclosed intermodal container can solve include the ability to carry heavy loads while maintaining a light TARE weight. The disclosed intermodal container may use a unique steel and design elements to accomplish this light TARE weight. In one embodiment, the steel may be a hot roll cold (HRCF) form steel which is high strength low alloy (HSLA); the commercial name is "DOMEX" and it is a commercial product supplied by Swedish Steel. Contact information for Swedish Steel is: SSAB AB, Klarabergsviadukten 70, D6, P.O Box 70; 101 21 Stockholm SWEDEN, Telephone: +46 8 45 45 700. The properties of Domex allow the use smaller/thinner steel with the same strength qualities as thicker standard steel. This keeps the TARE weight low and the strength high. The design elements such as bends in the steel, location of reinforcing elements, and type of steel allow for lighter materials to be used while still maintaining strength capabilities. The disclosed intermodal container also comprise design elements that make the process of stacking these containers safer by minimizing the risk of falling due to the design elements that center the disclosed intermodal containers when stacked on top of each other. The self-centering aspect of the design reduces the risk of items being stacked improperly and falling. The disclosed intermodal container also comprises bends in the corner post which allow for greater internal space which allows more material to be loaded in the disclosed intermodal container.

To solve the problem of maximizing available space, the disclosed intermodal container has been designed with dimensions in the multiple configurations around the available dimensions on transportation assets.

To solve the problem of protecting the material and equipment being transported, the disclosed intermodal container comprise adjustable shelving which can be adjusted to the sizes of the material package reducing the space around it for ancillary movement during transportation. Furthermore, for protection of material the disclosed intermodal container comprises design elements that serve as a form of shock absorbing/dampening by using a series of bends and angles incorporated into the base which reduces vibration that could damage material.

An additional element that may be incorporated into the disclosed intermodal containers are blocking and bracing mechanisms. These blocking and bracing mechanisms allow the disclosed intermodal container to be braced inside a shipping container, so that movement inside of that disclosed intermodal container which normally causes momentum which could damage material or damage the shipping container itself. The addition of blocking and bracing also provides an element where these disclosed intermodal container could also be secured to the floor if desired. In embodiments without integrated blocking and bracing, the maximizing of space reduces the amount of blocking and bracing if needed.

To reduce the overall weight of the disclosed intermodal container, the container comprises bends into elements such as corner posts to create greater strength allowing us to use lighter materials in manufacturing. In many instances there are weight limits to loads so by reducing the weight of the container while it is empty yet maintaining high strength standards it allows for more of the weight be applied to the limits from the material and not the container.

For security of the materials being shipped, the disclosed intermodal container comprises tabs and slides that prevent access inside of the container when assembled and lock. There is generally no way to get into these containers, short of using metal cutting tools, without removing the front panels.

The disclosed intermodal container has generally incorporated all of the problem solving design elements into the disclosed intermodal container itself, there is no need for additional equipment or material to solve the problems. There is no requirement for tools to assemble, disassemble or operate using our device. There is no known system that incorporates shock dampening or self centering corners for stacking in the market place.

The disclosed intermodal container is the lightest device available with the strength capabilities it possesses and this was achieved by the design elements we have incorporated to reduce the material weight for manufacturing.

The disclosed intermodal container may be made using hot rolled cold formed steel and steel mesh. Assembly parts may be laser cut to tolerance and then bent using a press break to drawing specifications. Parts may be welded together in accordance with production drawings and then hot-dip galvanized for protection from corrosion. Final assembly includes attaching hardware items and data plates. The disclosed intermodal container may then be flat-packed for delivery to the user.

FIG. 1 shows an exploded view of one embodiment of the disclosed intermodal container 10. The disclosed intermodal container comprises shelves 14 and posts 18. The version pictured has single long shelves 14 that are adjustable up and down. Another embodiment of the disclosed intermodal container has a split shelf version which has shelves that are generally about half the size of shelves 14 and adjustable up and down as well. The split shelves may be arranged in the disclosed intermodal container through the addition of a shelf support and also include divider walls. A front panel 58 may comprise two or more front panel supports 106. A rear panel 62 may also comprise two or more rear panel supports 118.

Figure 2:
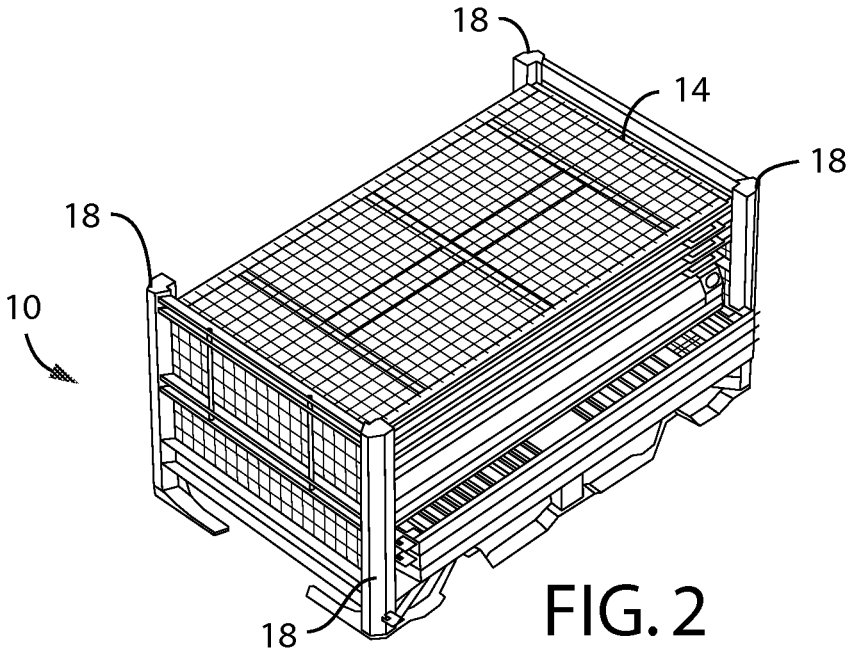
FIG. 2 is a view of the disclosed intermodal container from FIG. 1, but in a flat-packed configuration.

FIG. 2 shows a view of the disclosed intermodal container 10 from FIG. 1, but in a flat-packed configuration so that it can be transported in a small volume. The volume may be about 25%-30% of what an assembled item is. When flat-packed the intermodal containers are stackable with like items.

Figure 3:
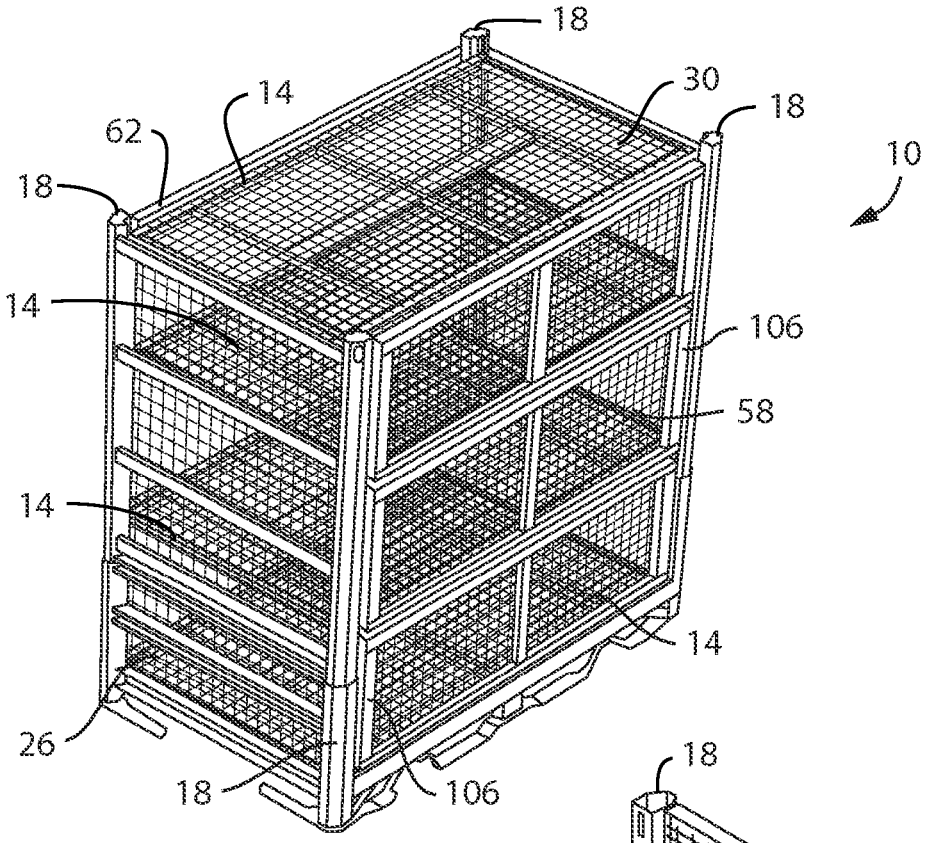
FIG. 3 is a view of the disclosed intermodal container in one assembled configuration.

FIG. 3 shows a view of the disclosed intermodal container 10 in one assembled configuration.

Figure 4:
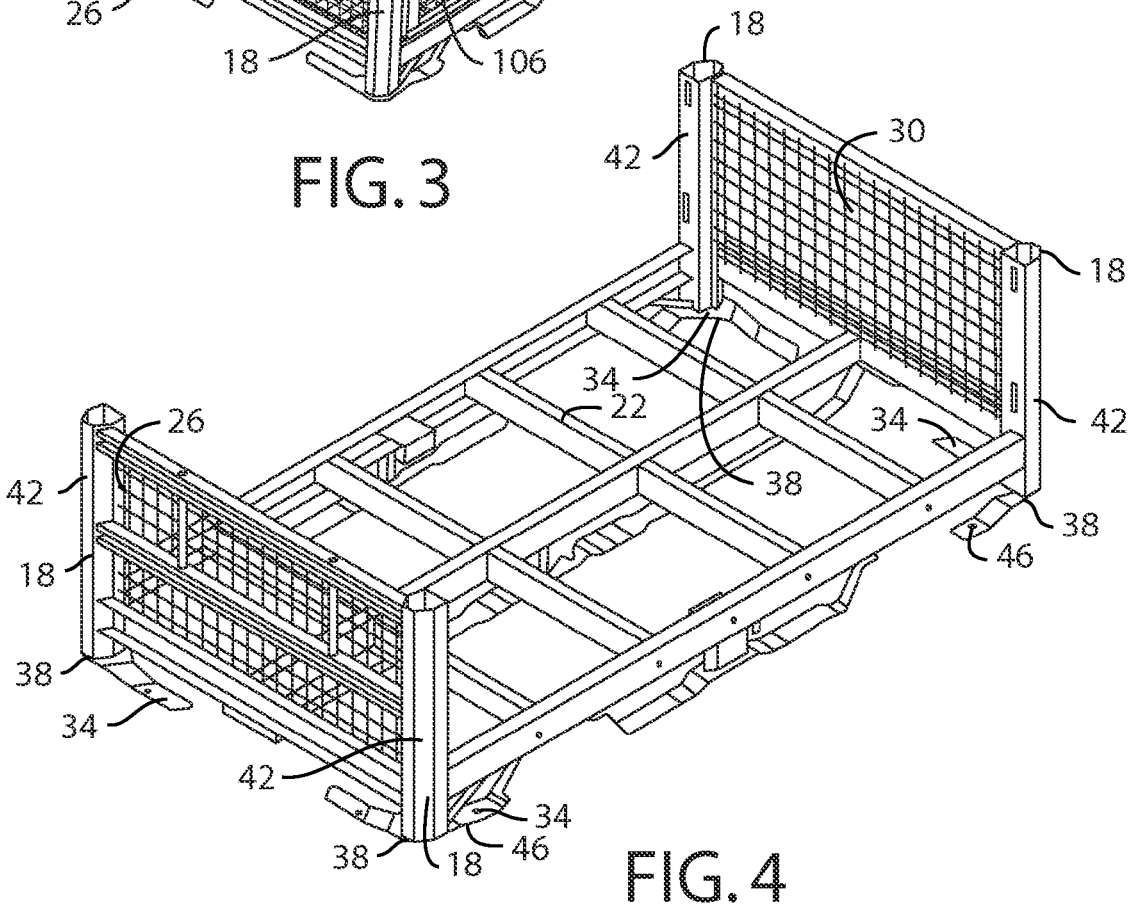
FIG. 4 is perspective view of the intermodal container showing some of the design elements.

FIG. 4 shows some of the design elements in the disclosed intermodal container 10. Only a portion of the intermodal container is shown in FIG. 4. The base 22 in communication with a first side panel 26 and a second side panel 30 are shown. The shock dampening design elements 34, self-centering corners 38, space optimizing corners posts 42, and blocking and bracing elements 46 are shown in this figure. Features 34, 38, 42, and 46 will be discussed in more detail below.

Figure 6:
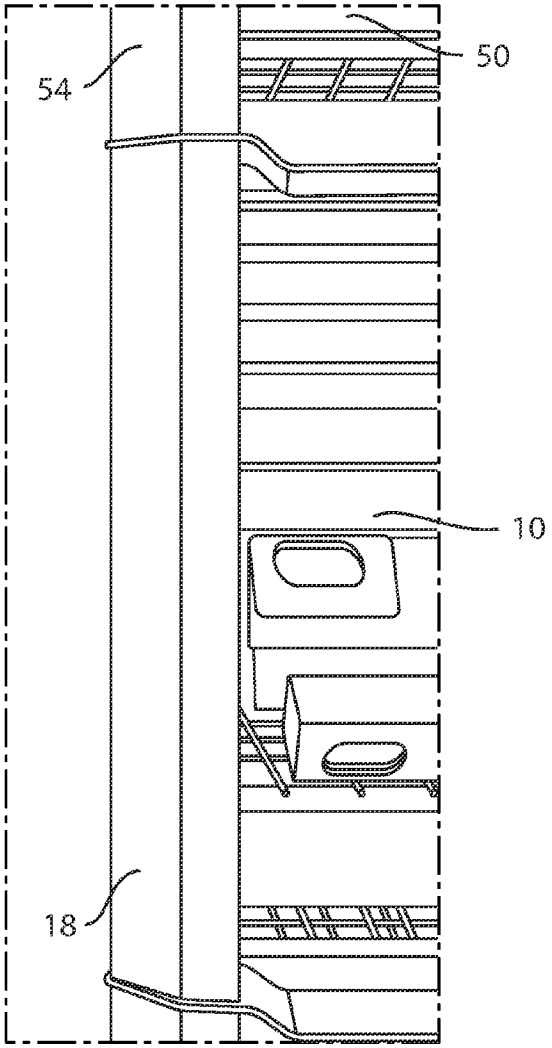
FIG. 6 is a close up view of the left corner post of a bottom intermodal container with a another intermodal container stacked on top of it.
Figure 5:
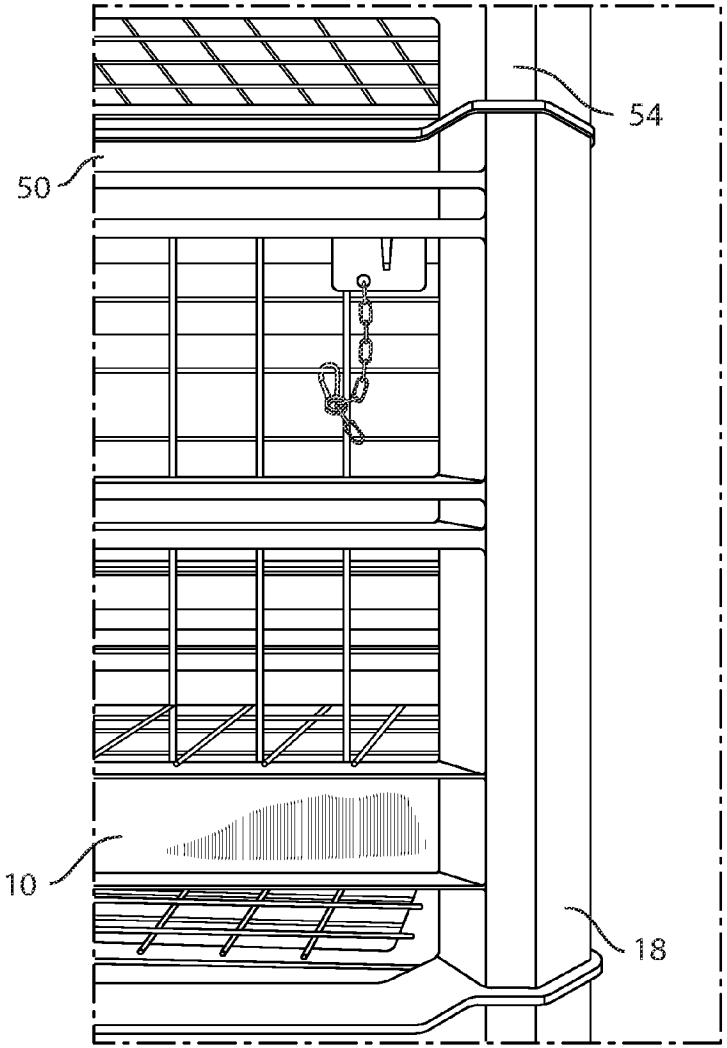
FIG. 5 is a close up view of the right corner post of a bottom intermodal container with another intermodal container stacked on top of it.

FIG. 5 shows a close up view of the right corner post 18 of a bottom intermodal container 10 with a top intermodal container 50 stacked on the bottom intermodal container 10. The corner post 18 of the bottom container 10 is shown lined up and stacked inside the corner post 54 of the top container 50. The cross-sectional shape of the corner posts 18 and 54 are generally convex polygons that match to each other. Due to the angles of the cross-sectional polygon shape of the posts 18, 54, when one stacks a top container 50 onto a bottom container 10, each pair of stacking posts 18, 54 will self-center, and force the containers 10, 50 to properly align in a safe stacked configuration. FIG. 6 is a close up view of the left corner post 18 of a bottom intermodal container 10 with a top intermodal container 50 stacked on the bottom intermodal container 10

Figure 7:
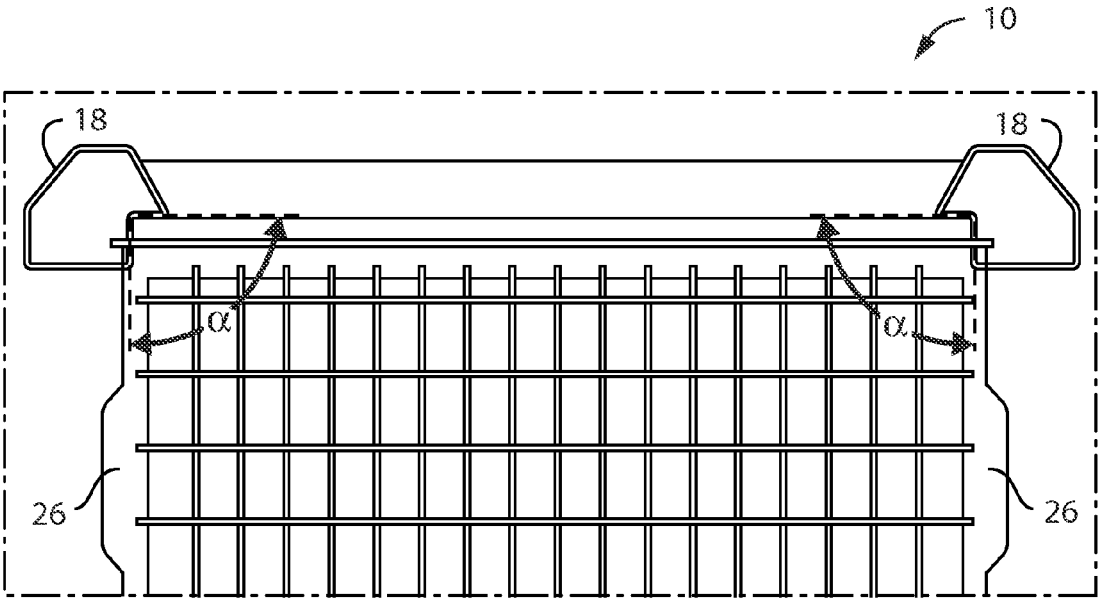
FIG. 7 is a close up top view of the rear corner posts of the disclosed intermodal container.
Figure 8:
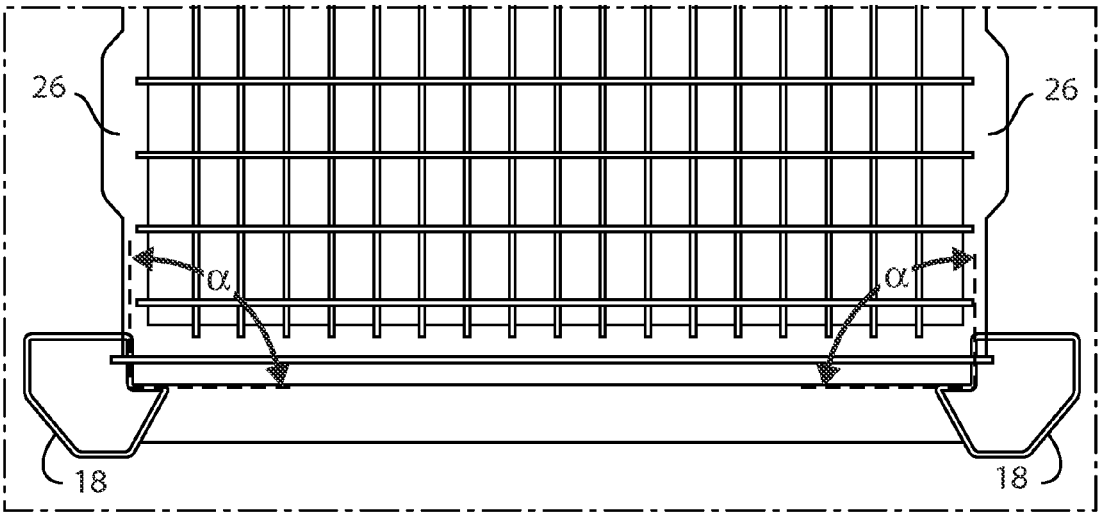
FIG. 8 is a close up top view of the front corners posts of the disclosed intermodal container.

FIG. 7 is a close up top view of the rear corners posts 18 of the disclosed intermodal container 10. In this view you can see the cross-sectional convex polygon shape of the posts 18, which allow for self-centering of disclosed intermodal containers. Further, the cross-sectional shape of the posts 18 has an angle $\alpha$ that is generally a right angle configured to maximize the space available on the disclosed intermodal container 10, in other words the angle $\alpha$ is oriented on the post 18 such that the post will generally not be in the way of the material being transported in the disclosed intermodal container. FIG. 8 is a close up top view of the front corners posts 18 of the disclosed intermodal container 10. In this view you can see the cross-sectional convex polygon shape of the posts 18, which allow for self-centering of disclosed intermodal containers. Further, the cross-sectional shape of the posts 18 has an angle $\alpha$ that is generally a right angle configured to maximize the space available on the disclosed intermodal container 10, in other words the angle $\alpha$ is oriented on the post 18 such that the post will generally not be in the way of the material being transported in the disclosed intermodal container.

Figure 9:
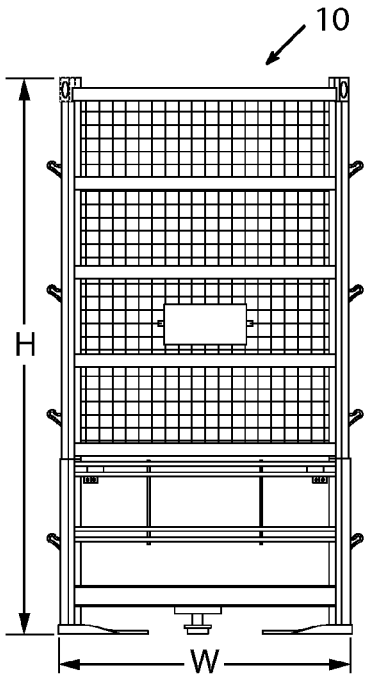
FIG. 9 is a side view of one embodiment of the disclosed intermodal container.
Figure 10:
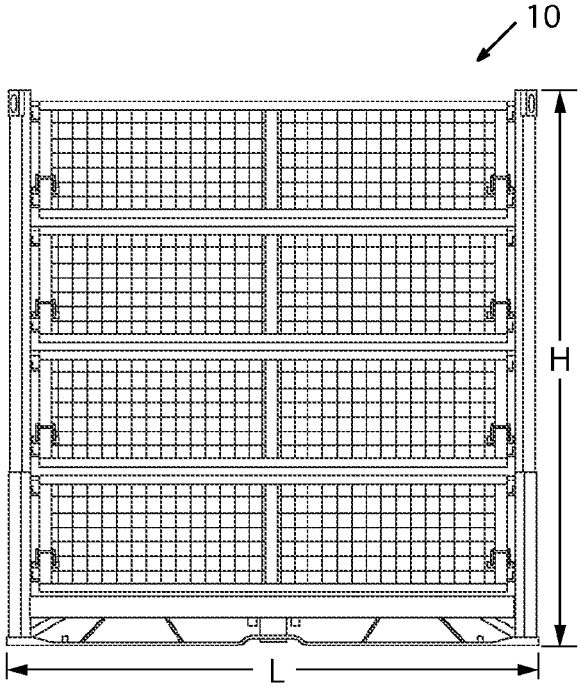
FIG. 10 is a front view of one embodiment of the disclosed intermodal container.

FIG. 9 is a side view of one embodiment of the disclosed intermodal container 10. FIG. 10 is a front view of one embodiment of the disclosed intermodal container 10. The intermodal container 10 has a width W, height H, and length L as shown. The dimensions of the disclosed intermodal container 10 have been designed to maximize available space inside various shipping means. Table 1 below shows the available space in different types of shipping platforms. This is the internal available space. Keep in mind that the door opening is smaller than the interior so it is impossible to get 100% fill using items to store large equipment. The percentage fills vary between the different shipping platforms to demonstrate the flexibility of the item between them. Although items above were listed as N/A does not mean the item won't fit in them just that they were not designed for them so % fill is not factored in. The goal was to get the best size that fits into as many platforms as possible while still meeting requirements.

TABLE 1

| Shipping Platform | Internal Width | Internal Length | Internal/ Door Height | CF |
|---|---|---|---|---|
| 40' Standard | 92" | 473" | 90" | 2266 |
| 40' High Cube | 92" | 473" | 96" | 2543 |
| 20' Standard | 92" | 231" | 90" | 1095 |
| 463 Air Pallet | 84" | 104" | 88" (60" Airdrop) | 445 |
| TRICON Container | 77" | 92" | 80" | 340 |
| QUADCON Container | 53" | 90" | 70" | 193 |
| ISU-90 Container (2-sides) | 39" | 102" | 84" | 387 |

Table 2 shows the models of disclosed intermodal container that incorporate the disclosed improvements and it also shows the type of shipping means they may be used for.

TABLE 2

| SharkCage Model | Width | Length | Height | CF |
|---|---|---|---|---|
| ISO20 XL (20', 40') | 44" | 110" | 85" | 238 |
| ISO20 XL Divided (20', 40') | 44" | 110" | 85" | 238 |
| QUADCON (20', 40', 463) | 42" | 52" | 68" | 86 |
| ISU-90 | 38" | 92" | 78" | 158 |
| ISU-90 Divided | 38" | 92" | 78" | 158 |
| ISU-90 Small | 38" | 44" | 78" | 75 |
| ISO20 Large (20', 40', 463) | 46" | 84" | 88" | 197 |
| ISO20 Large Divided (20', 40', 463) | 46" | 84" | 88" | 197 |
| ISO20 Medium (20', 40', 463) | 46" | 84" | 60" | 134 |
| ISO20 Medium Divided (20', 40', 463) | 46" | 84" | 60" | 134 |
| Secondary Load | 45" | 78" | 60" | 125 |
| Secondary Load Divided | 45" | 78" | 60" | 125 |
| ISO20 Small (20', 40', 463) | 46" | 84" | 44" | 98 |
| ISO20 Small Divided (20', 40', 463) | 46" | 84" | 44" | 98 |
| ISO20 XS(20', 40', 463) | 46" | 84" | 28" | 63 |

TABLE 2-continued

| SharkCage Model | Width | Length | Height | CF |
|---|---|---|---|---|
| ISO20 XS Divided (20', 40', 463) Warehouse | 46" | 84" | 28" | 63 |
| Warehouse Divided TRICON | 42" | 70" | 78" | 133 |
| TRICON Divided | 42" | 70" | 78" | 133 |
| W (20', 40') | 45" | 89" | 44" | 102 |
| Bike Track | 52" | 84" | 88" | 222 |
| Bike Track Divided | 52" | 84" | 88" | 222 |

Table 3 shows the quantity and percentage (%) fill of each model of the disclosed intermodal container in the applicable shipping means and how each intermodal container maximize the space used in the shipping means. A certain amount of space left over is necessary for maneuvering loads and uneven ground.

TABLE 3

| | QTY | 20' | 40' | TRI | QUAD | ISU-90 | 463L |
|---|---|---|---|---|---|---|---|
| CL/CS | 4 | 87% | N/A | N/A | N/A | N/A | N/A |
| | 8 | | 84% | N/A | N/A | N/A | N/A |
| I | 8 | 63% | 68% | N/A | 89% | N/A | 77% |
| ISLL/ISLS | 2 | N/A | N/A | N/A | N/A | 82% | N/A |
| ISS | 4 | N/A | N/A | N/A | N/A | 78% | N/A |
| M4L/M4S | 5 | 90% | | N/A | N/A | N/A | |
| | 10 | | 87% | N/A | N/A | N/A | |
| | 2 | | | N/A | N/A | N/A | 88% |
| M3L/M3S | 5 | 61% | | N/A | N/A | N/A | |
| | 10 | | 59% | N/A | N/A | N/A | |
| | 2 | | | N/A | N/A | N/A | 90%* |
| M2L/M2S | 10 | 90% | | N/A | N/A | N/A | |
| | 20 | | 87% | N/A | N/A | N/A | |
| | 4 | | | N/A | N/A | N/A | 88% |
| M1L/M1S | 15 | 86% | | N/A | N/A | N/A | |
| | 30 | | 83% | N/A | N/A | N/A | |
| | 6 | | | N/A | N/A | N/A | 84% |
| TL/TS | 6 | 73% | | | N/A | N/A | |
| | 12 | | 70% | | N/A | N/A | |
| | 2 | | | 78% | N/A | N/A | 60% |
| W | 10 | 93% | | N/A | N/A | N/A | N/A |
| | 20 | | 90% | N/A | N/A | N/A | N/A |
| BTL/BTS | 2 | 81% | 82% | N/A | N/A | N/A | 100% |

Figure 11:
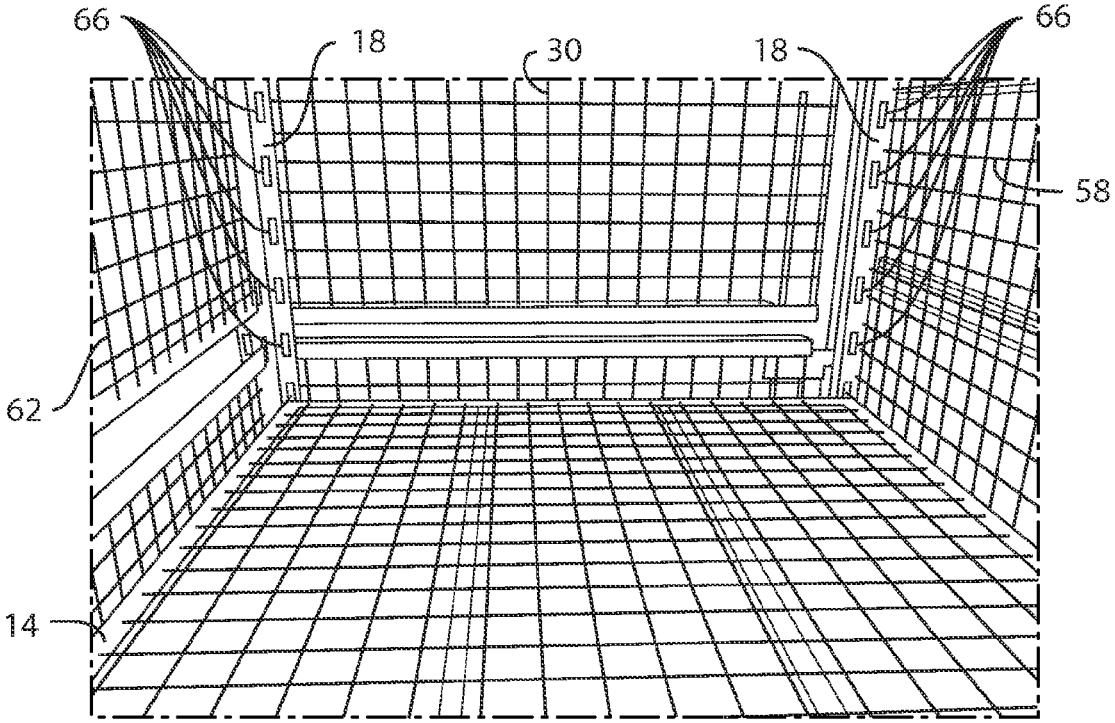
FIG. 11 is a view of the interior of a disclosed intermodal container.

*Designed for Airdrop Operations so available space is 60" in height for those operations FIG. 11 shows the interior of a disclosed intermodal container 10. A shelf 14 is shown adjacent to the second side panel 30, and a front panel 58 and a rear panel 62. The shelf height can be adjusted due to connection means in the posts 18. In one embodiment, the connection means may be slots 66 that are configured to accept tabs located on the shelves 14. Adjustable shelving allows for accommodating different sized materials reducing free space when transporting. The shelves 14 can be moved up and down into different positions.

Figure 12:
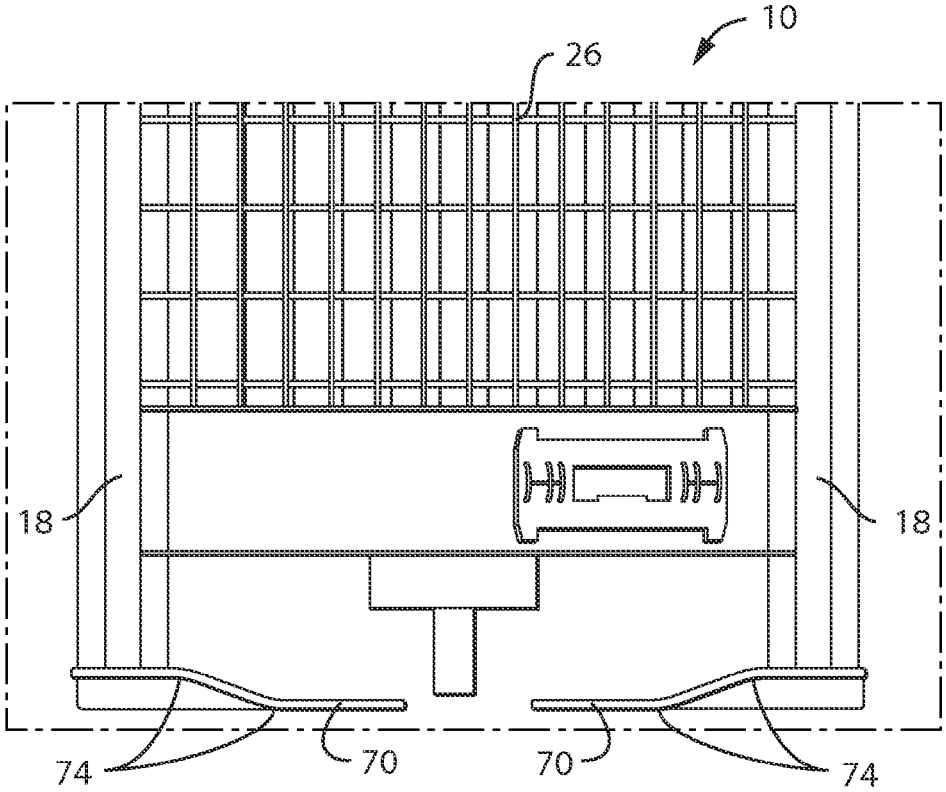
FIG. 12 is a close up view of the side support members.
Figure 13:
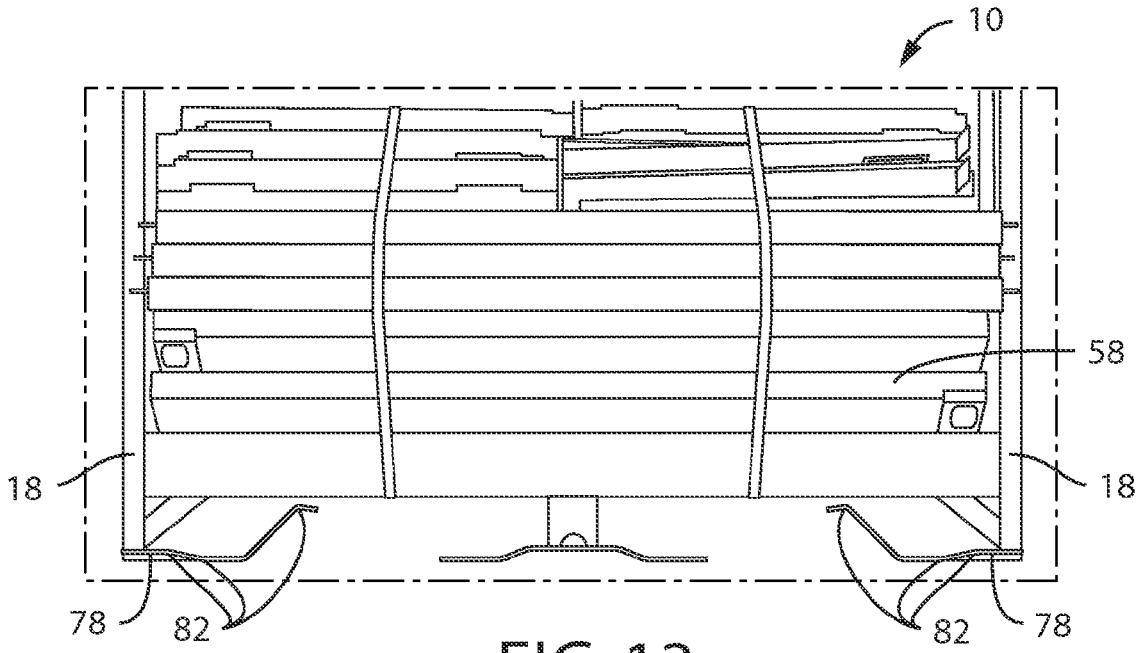
FIG. 13 is a close up view of the front support members.

FIG. 12 shows a close up view of the side support members 70 of the disclosed intermodal container 10. The side support members 70 may be in communication with the posts 18. The side support members 70 generally support the intermodal container 10 and may rest on the ground or surface where the container 10 is located. The side support member 70 extends generally from the post 18 to the post 18 on the opposite side of the container 10. The member 70 may have one or more bends 74. The member 70 with the bends 74 may act as very stiff springs that can provide shock dampening effects and reduce vibration protecting the material being transported from damage. The bends 74 may be generally obtuse angles, but may also form acute angles depending on the geometry. FIG. 13 shows a close up view of the front support members 78. The front support members 78 generally support the intermodal container 10 and may rest on the ground or surface where the container 10 is located. The front support member 78 extends generally from the post 18 towards a post 18 on the opposite side of the container. The member 78 may have one or more bends 82. The member 78 with the bends 82 may act as very stiff springs that can provide shock dampening effects and reduce vibration protecting the material being transported from damage. The bends 82 may be generally obtuse angles, but may also form acute angles depending on the geometry.

Figure 14:
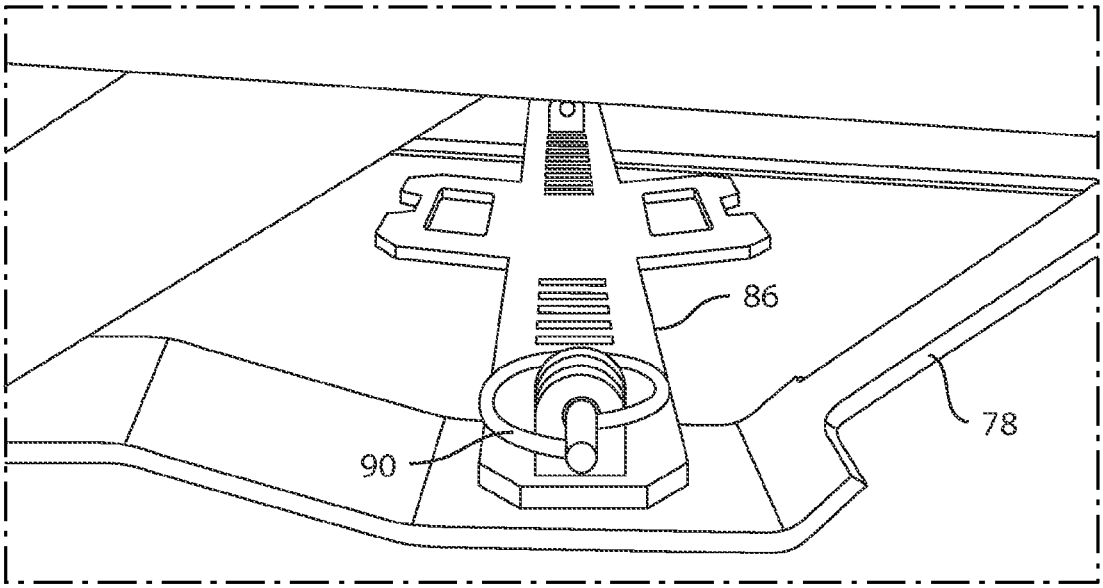
FIG. 14 shows the blocking and bracing member attached to a front support member.

Blocking and bracing material has been integrated into the intermodal container 10. Blocking and bracing materials are used for stabilizing the load while being transported in shipping containers. The integral blocking and bracing material eliminates the need for wood or separate blocking and bracing materials. Blocking and bracing can be configured to force the items being transported against the outside walls of the intermodal containers, thus stabilizing the items during movement. The blocking and bracing members may be integrated into the container 10 at both the bottom and top. In the bottom, as shown in FIG. 14, a blocking and bracing member 86 is attached to one or more front support members 78. The blocking and bracing member 86 may be removably attached to the front support members 78 using any suitable fasteners including but not limited to cotter pins and locking pins 90 The blocking and bracing member 86 can thus be stored generally under the container 10 while not in use and moved into position when necessary. On top they are stored inside the top horizontal bracing bar on the end wall and telescoped out when necessary, see FIGS. 18-23.

Figure 15:
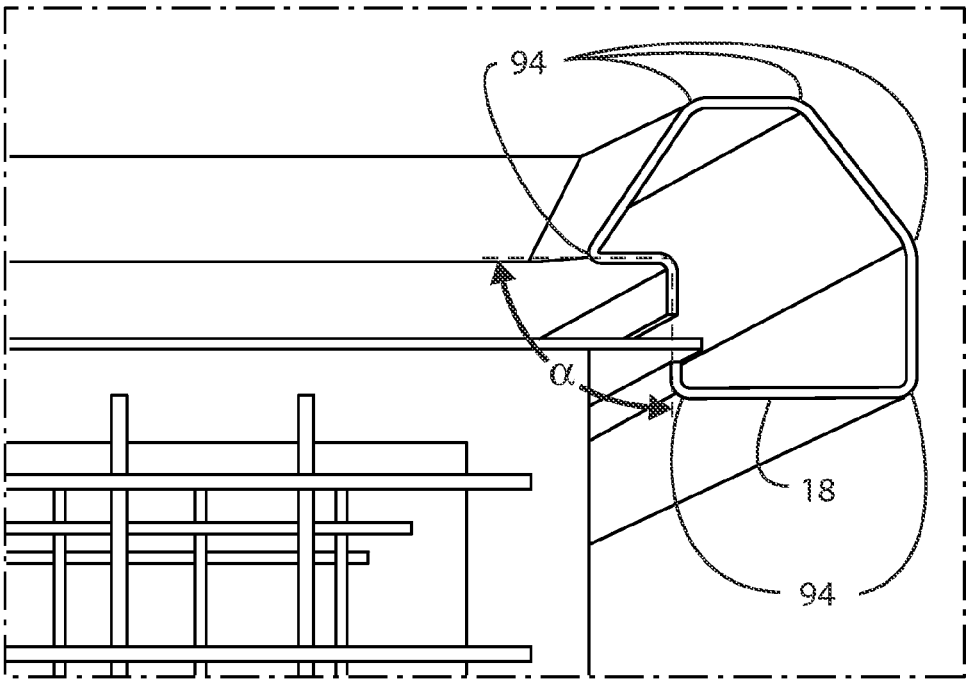
FIG. 15 is a top view that shows a cross-section of a post.

FIG. 15 is a top view that shows a cross-section of a post 18. To reduce the overall weight of the disclosed intermodal container 10, bends 94 have been designed into the corner posts to create greater strength allowing the use of lighter materials for the disclosed intermodal container 10.

Figure 16:
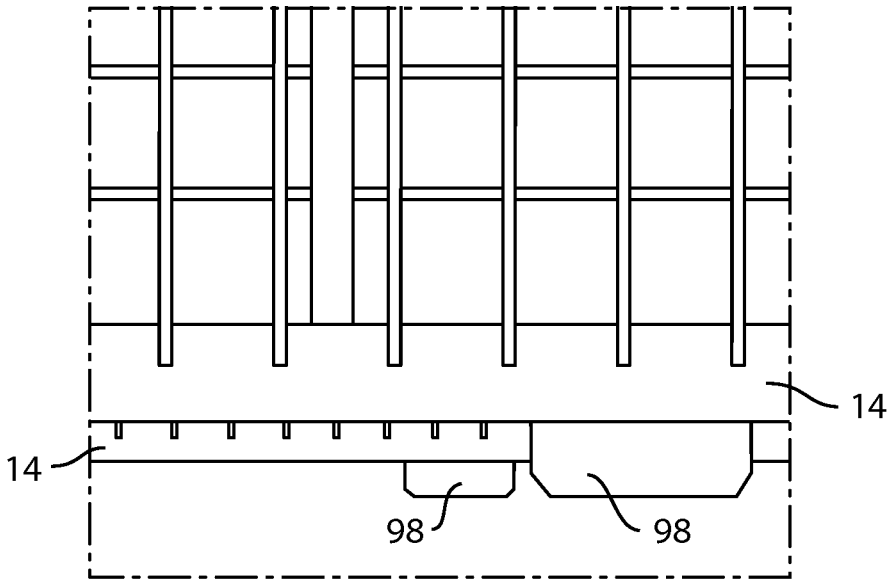
FIG. 16 shows a shelf with a shelf tab.
Figure 17:
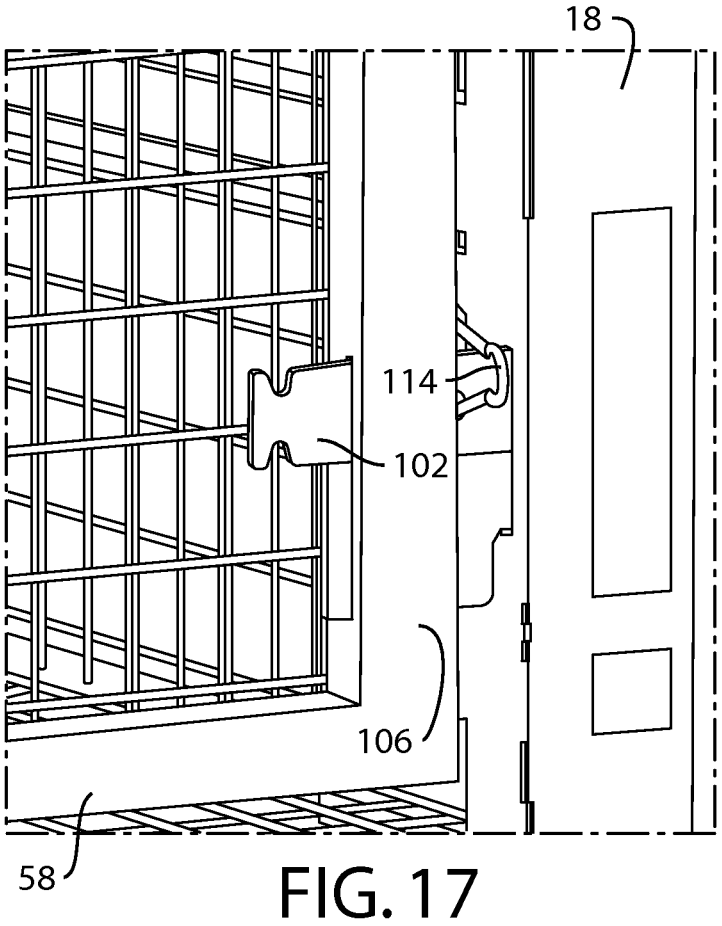
FIG. 17 shows a slideable member attached to a front panel and a post.

The shelves 14, front panel 58, and rear panel 62 may have security tabs and slide locks incorporated into them to prevent the removal of shelves and panels, thus securing the material being shipped. Shelf tabs prevent removing shelves while the front panels are in place making the item inaccessible. FIG. 16 shows a shelf 14 with a shelf tab 98 configured to slide into front panel 58 or rear panel 62. Slide locks are installed on the intermodal containers to lock the front panel 58, and rear panel 62 into the posts 18. FIG. 17 shows a front panel 58 adjacent to a post 18. A slideable member 102 can slide into a front panel support 106 and into post 18. A locking devices 114 can attach to a hole 110 in the slideable member that is located generally between the post 18 and the front panel support 106. When the pad lock 114 is attached and locked to the hole 110, the slideable member 102 cannot be removed from the post 18 and front panel support 106, and the front panel is locked in place, thereby preventing the removal of the material being transported. The locking device 114 may be a pad lock, or snap link may be used to simply hold the slideable member 102 in place (as shown).

Figure 18:
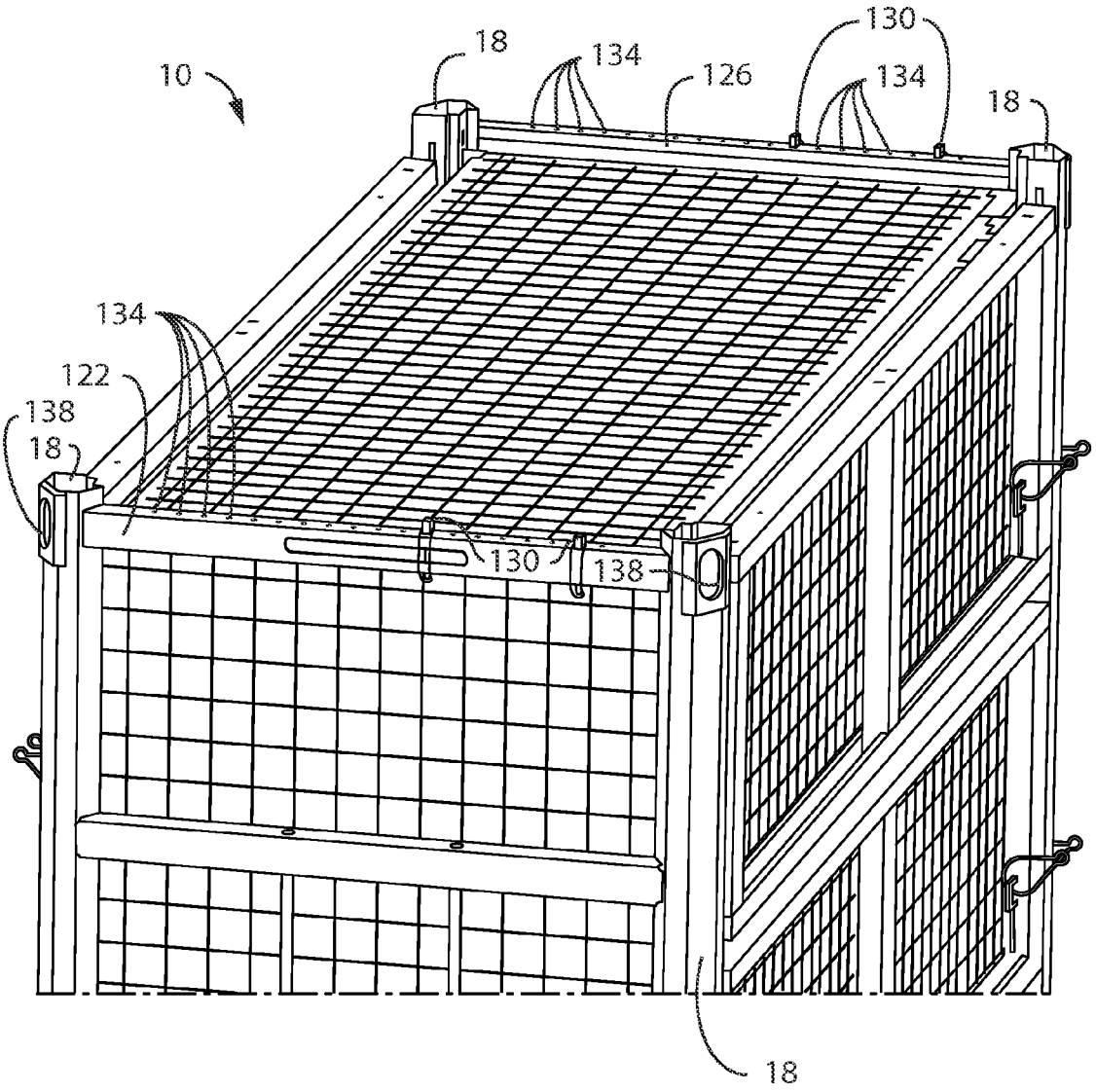
FIG. 18 shows a perspective view of the top of an intermodal container.

FIG. 18 shows a top perspective view of an intermodal container 10. A first cross-member 122 is located near the top and attached to two posts 18 on one side of the intermodal container 10. A second cross-member 126 is located near the top and attached to two posts 18 on the opposite side of the intermodal container 10. There are a plurality of holes 134 located through the top side and bottom side (bottom side not visible in this view) of cross-members 122, 126. Two locking pins 130 are stored in each cross-member 122, 126 via the holes 134. The cross-members 122, 126 each have an inner cross-member 194 (not visible in this view) that is slideable within the cross-member 122, 126. The inner cross-member 194 also has holes 134 located through the top side and bottom side of the inner cross-member. The inner cross-members 194 can slide out through the post holes 138 in the posts 18 (all four posts 18 have the holes 138). In FIG. 18, the inner cross-members 194 are stored generally completely inside the cross-members 122, 126. In one embodiment, only one of the two cross-members 122, 126 will have innermost cross-member 198 that slides within inner cross-member 194. The innermost cross-member 198 will also have holes 134 located through the top side and bottom side of the innermost cross-member 198. Innermost cross-member 198 is not visible in this view.

Figure 19:
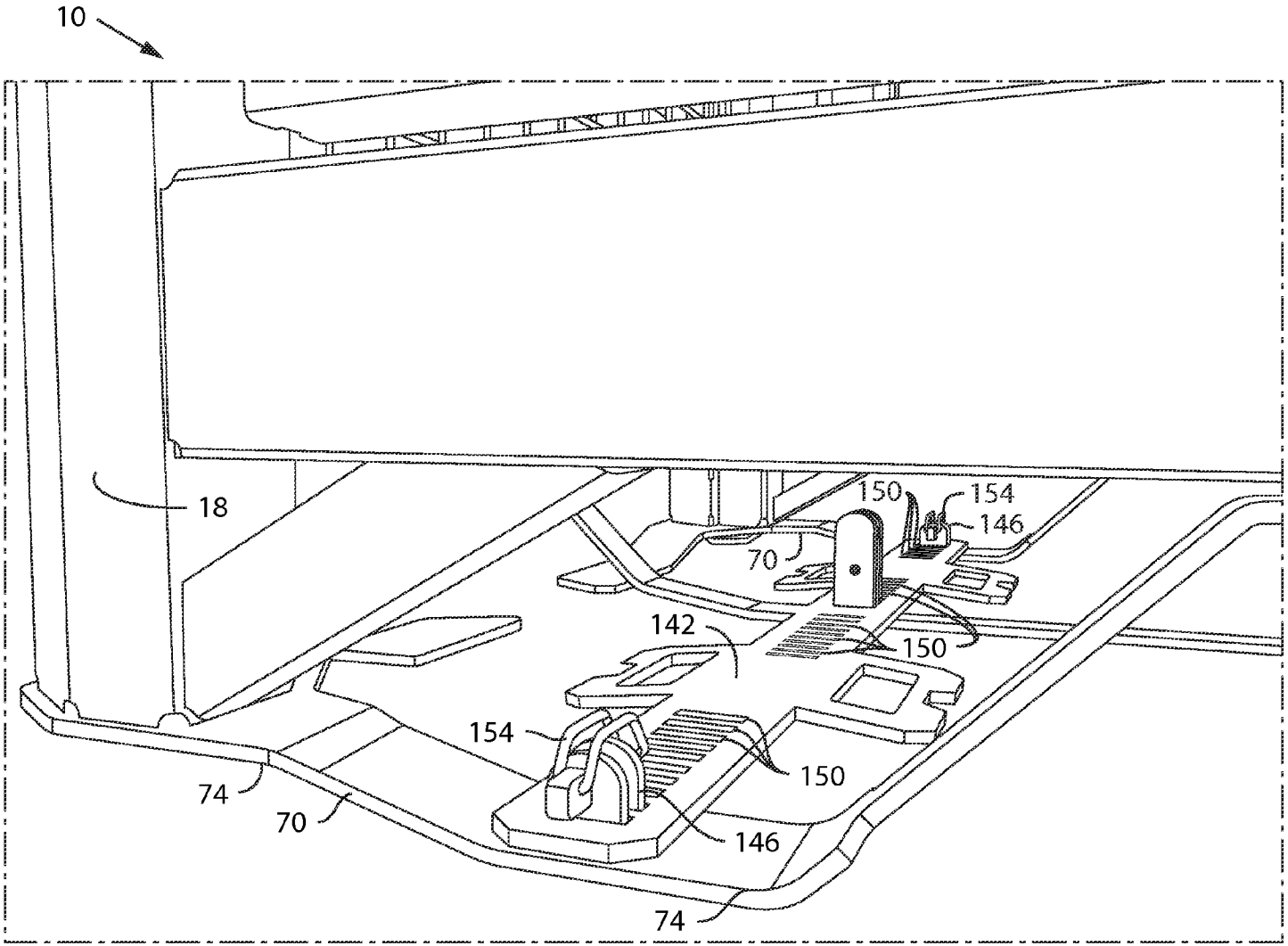
FIG. 19 shows a close-up view of a side support member and bracing member.

FIG. 19 shows a close up view of a side support member 70. A bottom bracing member 142 is removeably attached to the side support members 70 via at least two tabs 146 extending from the side support member 70 and going through at least one of a plurality of slots 150 located on the bottom bracing member 142. The tabs 146 have holes to go through them. A locking pin 154 goes through the holes to lock the bottom bracing member 142 to the side support members 70. When the locking pins 154 are removed, one can lift the bottom bracing member 142 from the tabs and move the bottom bracing member 142 so that the tabs 146 can go through another pair of slots 150, thereby extending the bottom bracing member 142 out from under the intermodal container 10. The bracing member 142 as shown in FIG. 19, is being stored under the intermodal container 10. There is a second bottom bracing member 158, slots 150, and tabs 146 and pins 154 attached to another side support member 70 not visible in this view.

Figure 20:
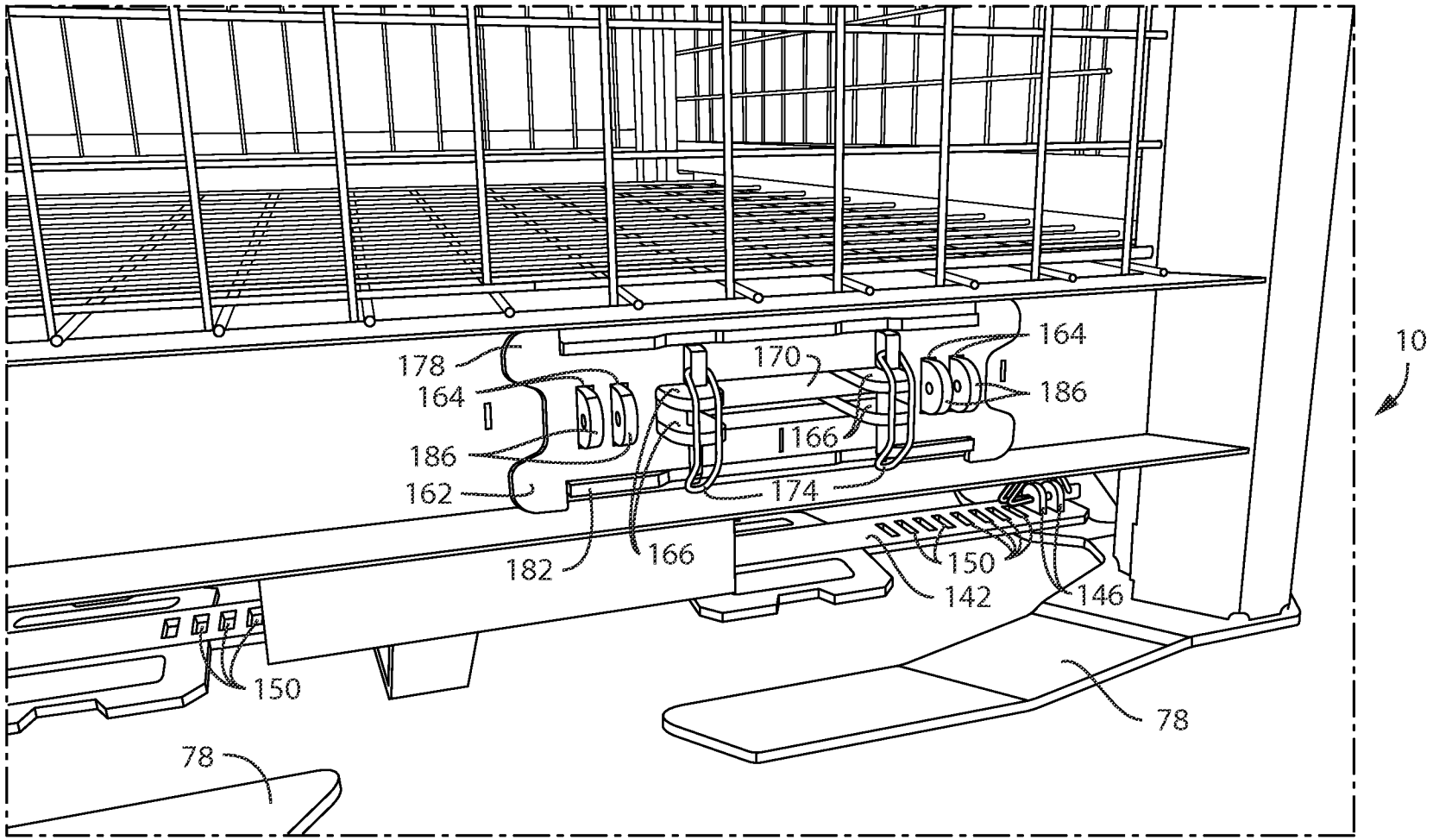
FIG. 20 shows a close-up view of a front support member and locking sleeve.

FIG. 20 shows one embodiment of how a locking sleeve 162 may be stored on the side of the intermodal container 10. Side tabs 166 are attached to a side of the intermodal container 10. The locking sleeve 162 has at least one slot 170 that allow the locking sleeve 162 to slide over the tabs 166. Locking pins 174 hold the locking sleeve 162 to the tabs 166. The locking sleeve 162 comprises an upper portion 178, and a lower portion 182. The lower portion has locking tabs 186. The locking sleeve 162 also has connector slots 164.

Figure 21:
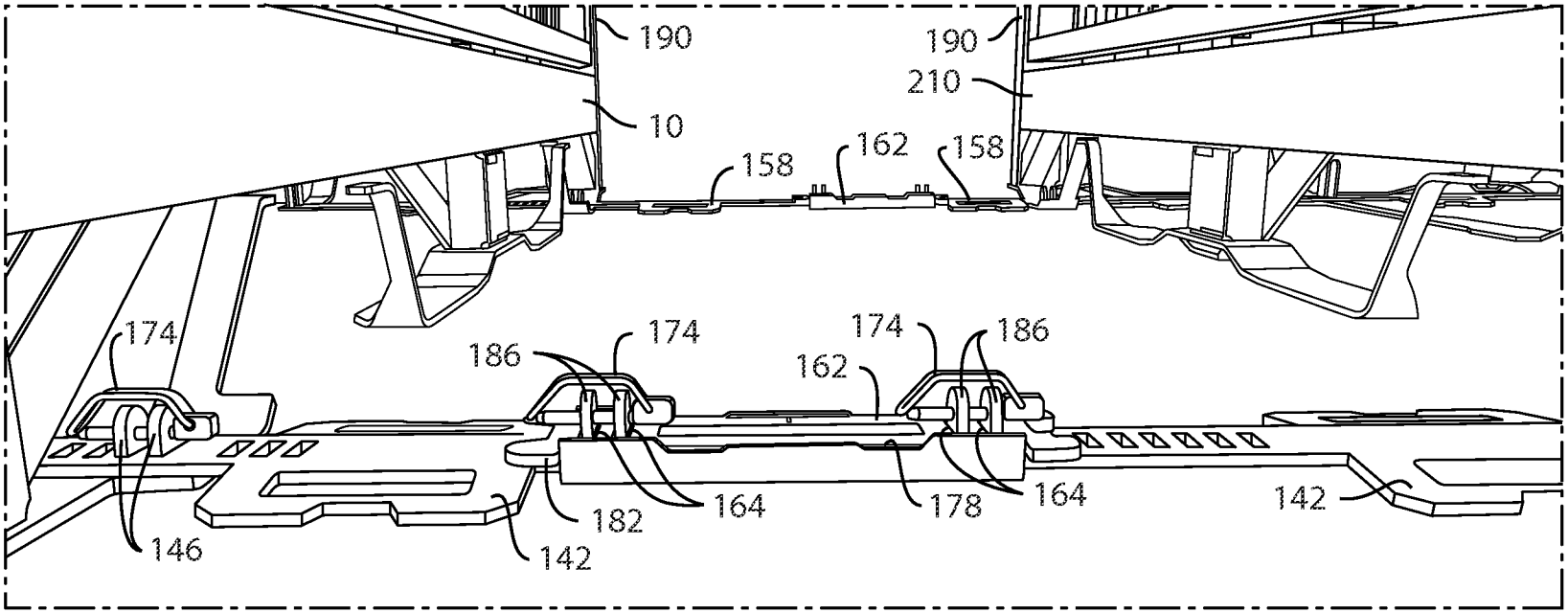
FIG. 21 shows a close-up view of a bottom bracing member.

FIG. 21 shows a view of the bottom of a first intermodal container 10 and a second intermodal container 210. A bottom bracing member 142 from the intermodal container 10 has been lifted up from the tabs 146, and moved from being completely under the intermodal container 10 and to the right, and is now attached to one set of tabs 146. The bottom bracing member 142 is also attached to the locking tabs 186 located on the lower portion 182 of the locking sleeve 162. Locking pins 174 hold the bottom bracing member 142 and upper portion 178 to the locking tabs 186. Similarly, a bottom bracing member 142 from the intermodal container 210 has been lifted up from the tabs 146, and moved from being completely under the intermodal container 10 and to the left, and is now attached to one set of tabs 146. The bottom bracing member 142 is also attached to the locking tabs 186 located on the lower portion 182 of the locking sleeve 162. Locking pins 174 hold the bottom bracing member 142 and upper portion 178 to the locking tabs 186. Similarly near the far end 190 of the intermodal container, the respect second bottom bracing members 158 are extended from under their respective intermodal containers 10, 210, and are connected to a locking sleeve 162.

Figure 22:
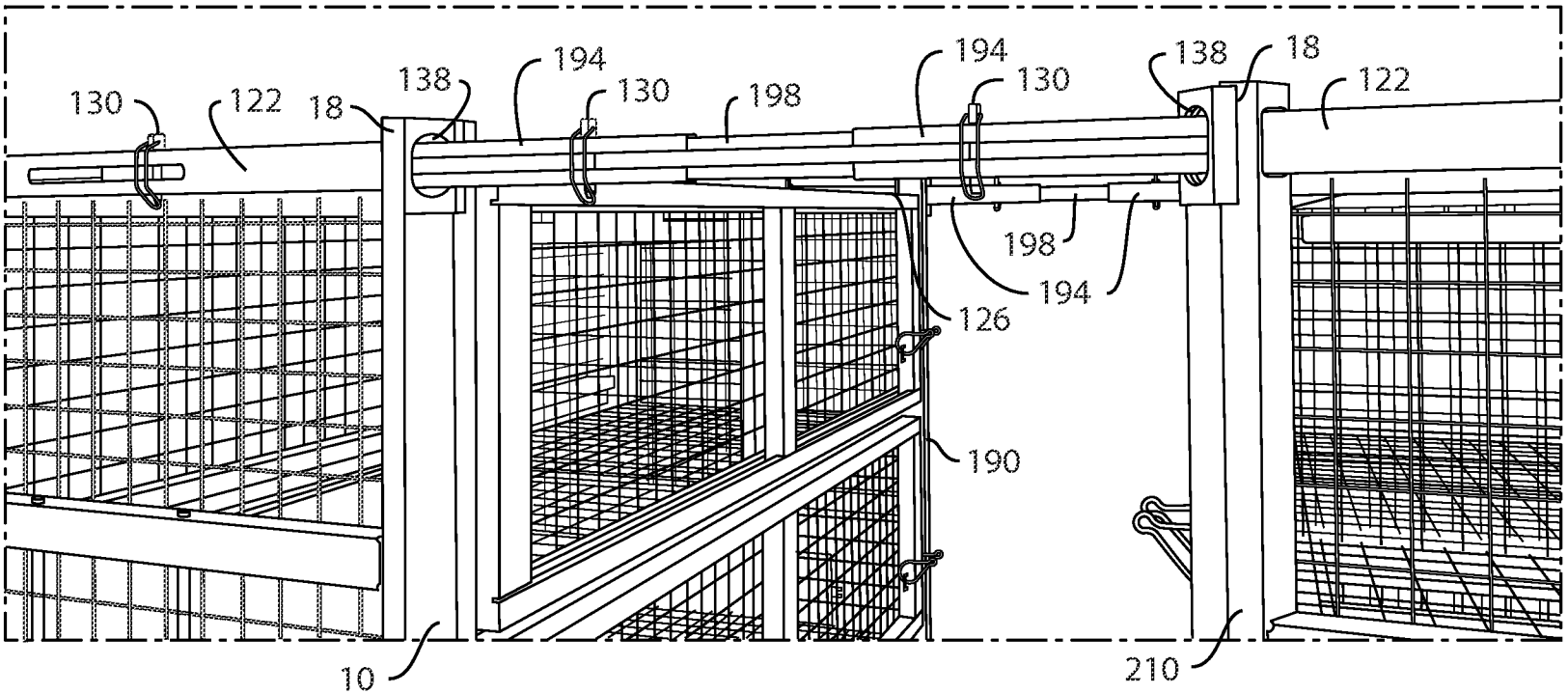
FIG. 22 shows a close-up view of the cross-members.

FIG. 22 shows a view of the top of a first intermodal container 10 and second intermodal container 210. Extending out and to the right from the cross-member 122 on the first intermodal container 10 is an inner cross-member 194. Extending from the inner cross-member 194 is an innermost cross-member 198. The innermost cross-member 198 is fixedly attached to the inner cross-member 194 via the locking pins 130 and the holes 134 in the cross-members 194, 198. Similarly, the inner cross-member 194 is fixedly attached to the cross-member 122 via the locking pins 130 and the holes 134 in the cross-members 194, 126. Extending out and to the left from the cross-member 122 of the second intermodal container 210 is an inner cross-member 194. The innermost cross-member 198 extends from the inner cross-member 194 of the first intermodal container 10 to the inner cross-member 194 of the second intermodal container 210. The innermost cross-member 198 is fixedly attached to the inner cross-member 194 (of the second intermodal container 210) via the locking pins 130 and the holes 134 in the cross-members 194, 198. Similarly, the inner cross-member 194 of the second intermodal container 210 is fixedly attached to the cross-member 122 of the second intermodal container 210 via the locking pins 130 and the holes 134 in the cross-members 194, 126 (not visible in this view). Similarly, near the far end 190 of the intermodal containers 10, 210, the cross-members 126 of both containers 10, 210, are telescoped and attached in generally the same way as the cross-members 122 described above.

Figure 23:
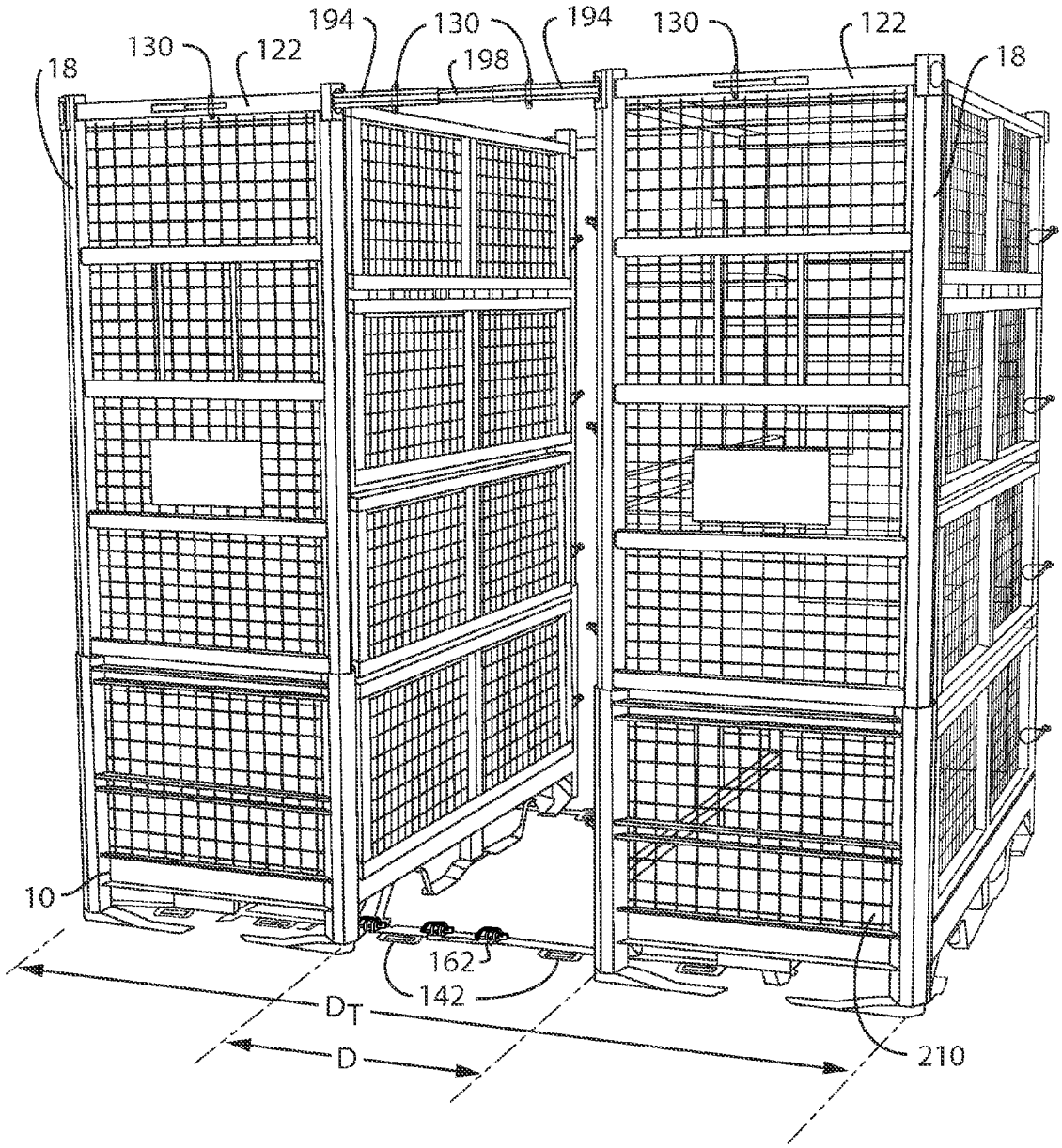
FIG. 23 shows a perspective view of two intermodal containers braced a certain distance apart.

FIG. 23 shows a view of the first and second intermodal containers 10, 210. In this view, one can see how the bracing members lock the two intermodal containers 10, 210 a certain distance D (variable by the user depending on which holes in the cross-members are pinned, and by which slots in the bottom bracing members are pinned). Thus, a user can use the bracing members to lock the two intermodal containers far enough apart so that they can be braced up against the interior of a shipping container. In other words, the distance $D_T$ may be generally the same, or just slightly smaller than the interior width or length of a shipping container. Hence, the intermodal containers 10, 210 and their contents will be secure and very unlikely to move or shift during transport. The bracing members are integral to the intermodal containers 10, 210, and thus, extra bracing material is not necessary.

This invention has many advantages. There is no requirement for tools to assemble, disassemble or operate the disclosed intermodal container. There is no other known system that incorporates shock dampening or self centering corners for stacking of the intermodal containers. The disclosed intermodal containers are the lightest containers available with the strength capabilities it possesses. Bracing and blocking members are integral to the container. The panels and shelving can be locked in place, preventing theft of the material being shipped. The intermodal containers efficiently use a great majority of the volume available in various shipping means.

It should be noted that the terms "first", "second", and "third", and the like may be used herein to modify elements performing similar and/or analogous functions. These modifiers do not imply a spatial, sequential, or hierarchical order to the modified elements unless specifically stated.

While the disclosure has been described with reference to several embodiments, it will be understood by those skilled in the art that various changes may be made and equivalents may be substituted for elements thereof without departing from the scope of the disclosure. In addition, many modifications may be made to adapt a particular situation or material to the teachings of the disclosure without departing from the essential scope thereof. Therefore, it is intended that the disclosure not be limited to the particular embodiments disclosed as the best mode contemplated for carrying out this disclosure, but that the disclosure will include all embodiments falling within the scope of the appended claims.

What is claimed is:

1. An intermodal container comprising:

a first post, the first post having a self-centering cross-section at the top of the post and the bottom of the post, and having an angle α facing towards the interior of the container and tending to maximize the volume available inside the container for transporting material;

a second post, the second post having a self-centering cross-section at the top of the post and the bottom of the post, and having an angle α facing towards the interior of the container and tending to maximize the volume available inside the container for transporting material;

a third post, the third post having a self-centering cross-section at the top of the post and the bottom of the post, and having an angle α facing towards the interior of the container and tending to maximize the volume available inside the container for transporting material;

a fourth post, the fourth post having a self-centering cross-section at the top of the post and the bottom of the post, and having an angle α facing towards the interior of the container and tending to maximize the volume available inside the container for transporting material;

a first side panel attached to two posts;

a second side panel attached to two other posts;

a front panel attached to two posts, the front panel comprising at least two front panel supports;

a rear panel attached to two other posts, the rear panel comprising at least two rear panel supports;

at least one shelf attached to the first, second, third, and fourth posts, and where the shelf can attach to posts at a plurality of heights from the bottom of the container;

wherein the width of the container is about 38 inches to about 52 inches, the length is about 44 inches to about 110 inches, and the height is about 28 inches to about 88 inches;

a side support member attached to a post and generally located in the same plane as the first side panel, the side support member having one or more bends configured such that the side support member acts as a very stiff spring that can provide shock dampening effects and reduce vibration to the interior of the container;

a front support member attached to a post, and generally located in the same plane as the front panel, the front support member having one or more bends configured such that the front support member acts as a very stiff spring that can provide shock dampening effects and reduce vibration to the interior of the container;

a removable blocking and bracing member attached to the side support member;

at least one tab extending from the shelf, and configured to slide into at least two of the group selected from the group consisting of the first side panel, the second side panel, the front panel, and the rear panel, thus when the tab is slid into two of the group, and the two of the group are in place in the container, the shelf cannot be removed;

a slideable member slideably attached to one of the front panel supports and to an adjacent post, a hole located in the slideable member between the front panel support and the adjacent post when the slideable member is fully engaged with the front panel support and the adjacent post;

a locking devices removeably attachable to the hole, and when removeably attachable to the hole, the slideable member cannot be removed from the post and the front panel support thereby locking the front panel in place with respect to the adjacent post; and wherein the cross-sectional area of each of the posts has more than 4 bends, where the bends are configured to provide greater strength to the posts while allowing for use of a lighter material.

2. The intermodal container of claim 1, wherein the bends in the side support member are of an obtuse angle; and wherein the bends in the front support member are of an obtuse angle.

3. The intermodal container of claim 1, further comprising:

a second side support member attached to a post and generally located in the same plane as the second side panel, the second side support member having one or more bends configured such that the second side support member acts as a very stiff spring that can provide shock dampening effects and reduce vibration to the interior of the container;

a rear support member attached to a post, and generally located in the same plane as the rear panel, the rear support member having one or more bends configured such that the rear support member acts as a very stiff spring that can provide shock dampening effects and reduce vibration to the interior of the container.

4. The intermodal container of claim 1, further comprising:

a slideable member slideably attached to one of the rear panel supports and to an adjacent post, a hole located in the slideable member between the rear panel support and the adjacent post when the slideable member is fully engaged with the rear panel support and the adjacent post; and a locking devices removeably attachable to the hole, and when removeably attachable to the hole, the slideable member cannot be removed from the post and the rear panel support thereby locking the rear panel in place with respect to the adjacent post.

5. The intermodal container of claim 3, where the locking device is selected from the group consisting of a padlock and a snaplink.

6. The intermodal container of claim 1, wherein the container is collapsible to a flat-pack volume of about 20% to about 30% of the original uncollapsed container volume.

7. The intermodal container of claim 1, wherein the container is generally made out of High Strength Low Alloy (HSLA) Steel that is hot rolled and cold formed.

8. The intermodal container of claim 1, further comprising:

at least two tabs extending from the side support member, each of the tabs having a hole through them;

at least two side tabs attached to one of the panels; each of the side tabs having a hole through them;

wherein the removable blocking and bracing member comprises:

a plurality of slots in the removable blocking and bracing member, configured to allow the tabs to slide through;

a locking pin configured to go through the hole in the tabs, and configured to removeably hold the removable blocking and bracing member against the side support member;

a locking sleeve, the locking sleeve comprising:

a lower portion, the lower portion with at least two locking tabs, each of the locking tabs with a hole through them;

an upper portion, removable form the lower portion, with at least two slots configured to slide over the at least two locking tabs, and at least one slot configured to slide over the two side tabs;

a locking pin configured to slide through the holes in the two side tabs and to removably attack the locking sleeve to one of the panels, and further configured to slide through the holes of the locking tab, and to removably attach the locking sleeve to the removable blocking and bracing member and to a second removable blocking and bracing member from a second intermodal container; and wherein the removable blocking and bracing member is storable completely under the intermodal container; and further the removable blocking and bracing member can be extended from under the intermodal container towards the front panel or the rear panel and attach to the second removable blocking and bracing member from the second intermodal container via the locking sleeve.

9. The intermodal container of claim 1, further comprising:

a first cross-member located near the top of the intermodal container, attached to two posts, and generally coplanar with the first side panel, the first cross-member having a plurality of holes located through the top side and bottom side of the first cross-member;

an inner cross-member in slideable communication with the first cross-member; and storable generally completely within the first cross-member; the inner cross-member having a plurality of holes located through the top side and bottom side of the inner cross-member, an innermost cross-member in slideable communication with the inner cross-member;

and storable generally completely within the inner cross-member; the innermost cross-member having a plurality of holes located through the top side and bottom side of the innermost cross-member, a first locking pin, configured to slide into the holes in the first cross-member, inner cross-member, and innermost cross-member, and removably lock the three cross-members in place with respect to one another;

a second locking pin, configured to slide into the holes in the first cross-member, inner cross-member, and innermost cross-member, and removably lock the three cross-members in place with respect to one another;

wherein the inner cross-member can extend out from the first cross-member, in a direction generally perpendicular to the front or rear panel;

wherein the innermost cross-member can extend out from the inner cross-member; in a direction generally perpendicular to the front or rear panel; and wherein the innermost cross-member can slide into an inner cross-member from a second intermodal container, and can be locked in place via the locking pins.

10. The intermodal container of claim 9, further comprising:

a second cross-member located near the top of the intermodal container, attached to two posts, and generally coplanar with the second side panel, the second cross-member having a plurality of holes located through the top side and bottom side of the second cross-member;

a second inner cross-member in slideable communication with the second cross-member;

and storable generally completely within the second cross-member; the second inner cross-member having a plurality of holes located through the top side and bottom side of the second inner cross-member, a first locking pin, configured to slide into the holes in the second cross-member, and second inner cross-member, and removably lock the two cross-members in place with respect to one another;

a second locking pin, configured to slide into the holes in the second cross-member, and second inner cross-member, and removably lock the two cross-members in place with respect to one another;

wherein the second inner cross-member can extend out from the second cross-member, in a direction generally perpendicular to the front or rear panel; and wherein an innermost cross-member from a second intermodal container can slide into the second inner cross-member, and can be locked in place via the locking pins.

11. An intermodal container comprising:

a first post;

a first side panel attached to the first post;

a second post, attached to the first side panel;

a third post;

a second side panel attached to the third post;

a fourth post attached to the second side panel;

a front panel attached to the first and fourth posts;

a rear panel attached to the second and third posts;

at least one shelf attached to the first, second, third, and fourth posts, and where the shelf can attach to the posts at a plurality of heights along the posts;

a support member attached to at least one post selected from the group consisting of the first post, second post, third post, and fourth post; and generally located in the same plane as a panel selected from the group consisting of the first side panel, second side panel, front panel, and rear panel, the support member configured to generally support at least a portion of the weight of the intermodal container, the support member having one or more bends configured such that the support member acts as a very stiff spring that can provide shock dampening effects and reduce vibration to the interior of the container;

at least two tabs extending from the support member, each of the tabs having a hole through them;

at least two side tabs attached to one of the panels; each of the side tabs having a hole through them;

wherein the removable blocking and bracing member comprises:

a plurality of slots in the removable blocking and bracing member, configured to allow the tabs to slide through;

a locking pin configured to go through the hole in the tabs, and configured to removeably hold the removable blocking and bracing member against the side support member;

a locking sleeve, the locking sleeve comprising:

a lower portion, the lower portion with at least two locking tabs, each of the locking tabs with a hole through them;

an upper portion, removable form the lower portion, with at least two slots configured to slide over the at least two locking tabs, and at least one slot configured to slide over the two side tabs;

a locking pin configured to slide through the holes in the two side tabs and to removably attack the locking sleeve to one of the panels, and further configured to slide through the holes of the locking tab, and to removably attach the locking sleeve to the removable blocking and bracing member and to a second removable blocking and bracing member from a second intermodal container; and wherein the removable blocking and bracing member is storable completely under the intermodal container; and further the removable blocking and bracing member can be extended from under the intermodal container towards the front panel or the rear panel and attach to the second removable blocking and bracing member from the second intermodal container via the locking sleeve.

12. The intermodal container of claim 11, further comprising:

a first cross-member located near the top of the intermodal container, attached to two posts, and generally coplanar with the first side panel, the first cross-member having a plurality of holes located through the top side and bottom side of the first cross-member;

an inner cross-member in slideable communication with the first cross-member; and storable generally completely within the first cross-member; the inner cross-member having a plurality of holes located through the top side and bottom side of the inner cross-member, an innermost cross-member in slideable communication with the inner cross-member; and storable generally completely within the inner cross-member; the innermost cross-member having a plurality of holes located through the top side and bottom side of the innermost cross-member, a first locking pin, configured to slide into the holes in the first cross-member, inner cross-member, and innermost cross-member, and removably lock the three cross-members in place with respect to one another;

a second locking pin, configured to slide into the holes in the first cross-member, inner cross-member, and innermost cross-member, and removably lock the three cross-members in place with respect to one another;

wherein the inner cross-member can extend out from the first cross-member, in a direction generally perpendicular to the front or rear panel;

wherein the innermost cross-member can extend out from the inner cross-member; in a direction generally perpendicular to the front or rear panel; and wherein the innermost cross-member can slide into an inner cross-member from a second intermodal container, and can be locked in place via the locking pins.

13. The intermodal container of claim 12, further comprising:

a second cross-member located near the top of the intermodal container, attached to two posts, and generally coplanar with the second side panel, the second cross-member having a plurality of holes located through the top side and bottom side of the second cross-member;

a second inner cross-member in slideable communication with the second cross-member; and storable generally completely within the second cross-member; the second inner cross-member having a plurality of holes located through the top side and bottom side of the second inner cross-member, a first locking pin, configured to slide into the holes in the second cross-member, and second inner cross-member, and removably lock the two cross-members in place with respect to one another;

a second locking pin, configured to slide into the holes in the second cross-member, and second inner cross-member, and removably lock the two cross-members in place with respect to one another;

wherein the second inner cross-member can extend out from the second cross-member, in a direction generally perpendicular to the front or rear panel; and wherein an innermost cross-member from a second intermodal container can slide into the second inner cross-member, and can be locked in place via the locking pins.

14. An intermodal container comprising:

a first post;

a first side panel attached to the first post;

a second post, attached to the first side panel;

a third post;

a second side panel attached to the third post;

a fourth post attached to the second side panel;

a front panel attached to the first and fourth posts;

a rear panel attached to the second and third posts;

at least one shelf attached to the first, second, third, and fourth posts, and where the shelf can attach to the posts at a plurality of heights along the posts;

a removable blocking and bracing member attached to the support member;

at least two tabs extending from the support member, each of the tabs having a hole through them;

at least two side tabs attached to one of the panels; each of the side tabs having a hole through them;

wherein the removable blocking and bracing member comprises:

a plurality of slots in the removable blocking and bracing member, configured to allow the tabs to slide through;

a locking pin configured to go through the hole in the tabs, and configured to removeably hold the removable blocking and bracing member against the side support member;

a locking sleeve, the locking sleeve comprising:

a lower portion, the lower portion with at least two locking tabs, each of the locking tabs with a hole through them;

an upper portion, removable form the lower portion, with at least two slots configured to slide over the at least two locking tabs, and at least one slot configured to slide over the two side tabs;

a locking pin configured to slide through the holes in the two side tabs and to removably attack the locking sleeve to one of the panels, and further configured to slide through the holes of the locking tab, and to removably attach the locking sleeve to the removable blocking and bracing member and to a second removable blocking and bracing member from a second intermodal container; and wherein the removable blocking and bracing member is storable completely under the intermodal container; and further the removable blocking and bracing member can be extended from under the intermodal container towards the front panel or the rear panel and attach to the second removable blocking and bracing member from the second intermodal container via the locking sleeve.

15. The intermodal container of claim 14, further comprising:

a first cross-member located near the top of the intermodal container, attached to two posts, and generally coplanar with the first side panel, the first cross-member having a plurality of holes located through the top side and bottom side of the first cross-member;

an inner cross-member in slideable communication with the first cross-member; and storable generally completely within the first cross-member; the inner cross-member having a plurality of holes located through the top side and bottom side of the inner cross-member, an innermost cross-member in slideable communication with the inner cross-member; and storable generally completely within the inner cross-member; the innermost cross-member having a plurality of holes located through the top side and bottom side of the innermost cross-member, a first locking pin, configured to slide into the holes in the first cross-member, inner cross-member, and innermost cross-member, and removably lock the three cross-members in place with respect to one another;

a second locking pin, configured to slide into the holes in the first cross-member, inner cross-member, and innermost cross-member, and removably lock the three cross-members in place with respect to one another;

wherein the inner cross-member can extend out from the first cross-member, in a direction generally perpendicular to the front or rear panel;

wherein the innermost cross-member can extend out from the inner cross-member; in a direction generally perpendicular to the front or rear panel; and wherein the innermost cross-member can slide into an inner cross-member from a second intermodal container, and can be locked in place via the locking pins.

16. The intermodal container of claim 15, further comprising:

a second cross-member located near the top of the intermodal container, attached to two posts, and generally coplanar with the second side panel, the second cross-member having a plurality of holes located through the top side and bottom side of the second cross-member;

a second inner cross-member in slideable communication with the second cross-member; and storable generally completely within the second cross-member; the second inner cross-member having a plurality of holes located through the top side and bottom side of the second inner cross-member, a first locking pin, configured to slide into the holes in the second cross-member, and second inner cross-member, and removably lock the two cross-members in place with respect to one another;

a second locking pin, configured to slide into the holes in the second cross-member, and second inner cross-member, and removably lock the two cross-members in place with respect to one another;

wherein the second inner cross-member can extend out from the second cross-member, in a direction generally perpendicular to the front or rear panel; and wherein an innermost cross-member from a second intermodal container can slide into the second inner cross-member, and can be locked in place via the locking pins.

* * * * *